United States Patent [19]

Inoue

[11] Patent Number: 4,912,845

[45] Date of Patent: Apr. 3, 1990

[54] SHAVER

[76] Inventor: Shoichi Inoue, 3-12-23 Kitakokubu, Ichikawa-shi, Chiba-ken, Japan

[21] Appl. No.: 156,714

[22] Filed: Feb. 17, 1988

[51] Int. Cl.[4] ..... B26B 19/14

[52] U.S. Cl. ..... 30/43.4

[58] Field of Search ..... 30/43.4, 43.5, 43, 34 R

[56] References Cited

U.S. PATENT DOCUMENTS 3,037,281 6/1962 Arey ..... 30/43.4

3,949,469 4/1976 Brauss ..... 30/43.4

FOREIGN PATENT DOCUMENTS 908115 10/1962 United Kingdom ..... 30/43.5

1030100 5/1966 United Kingdom ..... 30/43.4

*Primary Examiner*—Frank T. Yost

*Assistant Examiner*—Willmon Fridie, Jr.

*Attorney, Agent, or Firm*—Leydig, Voit & Mayer

[57] ABSTRACT

In a shaver a housing supports a cylindrical blade carrier carrying a blade. A rotatable cylindrical mesh encircles the blade and carrier. As the mesh is drawn across the face, bristles enter the mesh and are cut as the mesh slides across the cutting edge of the blade. The mesh is formed from a flat sheet which is rolled into a cylinder, the ends of the mesh overlapping to form a seam. The overlap is arranged so that the edge of the inner layer faces away from the cutting edge of the blade to prevent it catching on the blade.

7 Claims, 1 Drawing Sheet

SHAVER

INTRODUCTION

The present invention relates to a portable shaver.

BACKGROUND

FIG. 1 shows a prior art portable shaver which comprises a plastics housing 31 having a part cylindrical plastics holder 32 which carries a stainless steel V-shaped blade 34 in a groove 33 in the holder 32. The blade 34 and holder 32 are surrounded by a stainless steel cylindrical mesh 35 which is mounted so as to rotate around the blade 34 and holder 32. The blade 34 has a cutting edge 34*a* which is positioned close to the mesh 35. In operation, the mesh 35 is rolled down the face or other surface to be shaved. The hairs of the beard stubble penetrate apertures of the mesh 35 and the hairs are dragged on to the cutting edge 34*a*. The device is capable of providing a simple and compact portable razor requiring no electrical or complex mechanical parts. However, the manufacture of the prior art device is expensive because of the cost of the mesh 35. The operation of forming the mesh 35 from a cylindrical tube of stainless steel is very expensive, requiring the formation of apertures in the cylinder to form the mesh and then lapping to remove burrs and reduce the cylinder to the required thickness.

SUMMARY OF THE INVENTION

The present invention provides a shaver comprising a manually grippable holder, a blade supported in the holder, the blade having a longitudinally extending cutting edge, and a cylindrical mesh surrounding the blade and mounted to rotate around the blade to provide a cutting action between the mesh and the blade, wherein the mesh is formed in a flat sheet of material which is rolled to form a cylinder.

Preferably, the sheet is rolled so that its circumferential ends overlap, the overlapping portions being fastened together, for example, by welding or gluing.

For most effective operation, the mesh is rotated in a preferred direction over the blade with the the cutting edge of the blade facing the opposite direction. The overlapping ends of the sheet mesh are preferably arranged so that the edge of the inner overlapping mesh end faces in the same direction as the blade, whereby the mesh can be rotated smoothly over the blade.

The invention thus provides a shaver which has the advantages of the prior art device but is cheaper to produce, providing a readily disposable shaver which can be of very compact form.

Other preferred features and advantages of the invention will be apparent from the following description and the accompanying claims.

BRIEF DESCRIPTION OF THE DRAWINGS

.

DESCRIPTION OF THE PREFERRED EMBODIMENT

Figure 1:
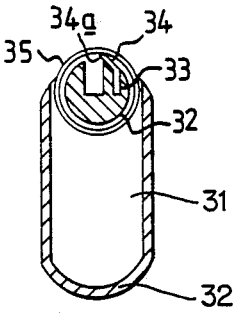
FIG. 1 is a cross-sectional view of a prior art shaver, similar to the view seen in FIG. 3.
Figure 2:
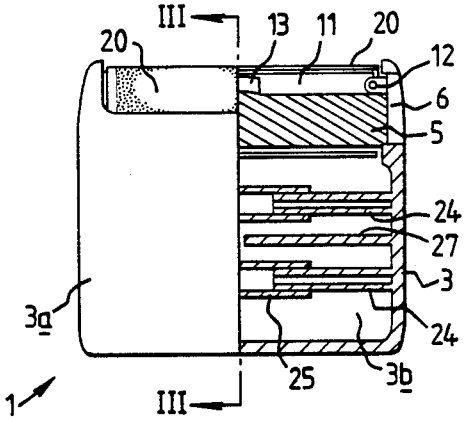
FIG. 2 is a front view partly cut away of a shaver according to the invention.
Figure 3:
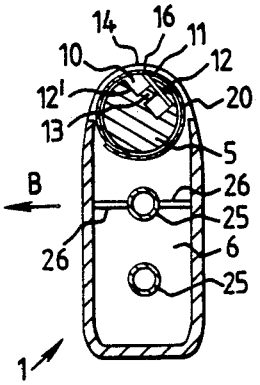
FIG. 3 is a cross-sectional view along the line III—III of FIG. 2.
Figure 4:
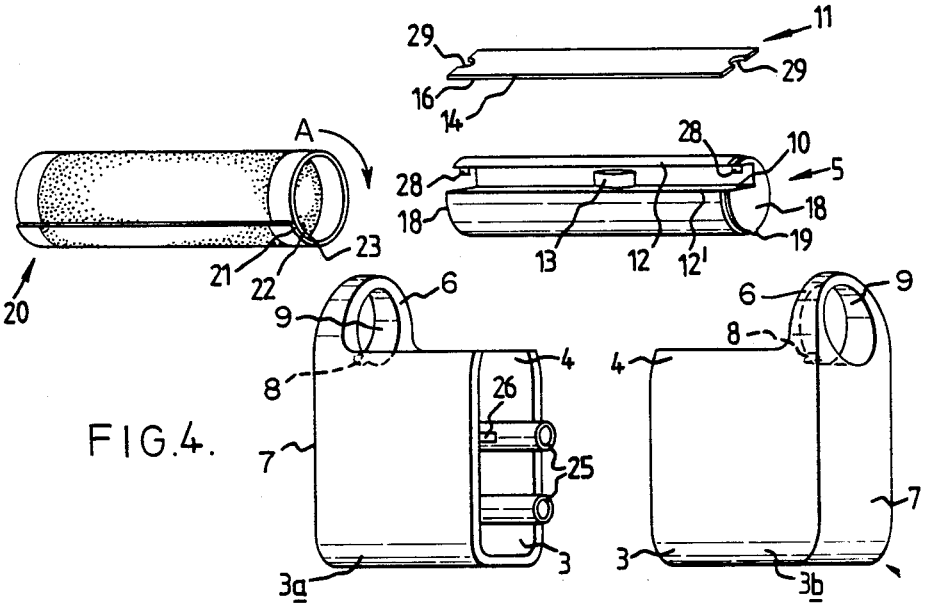
FIG. 4 is an exploded, perspective view of the shaver of FIG. 2.

In the drawings, a shaver 1 according to the invention comprises a holder 2 comprising a housing 3 which is moulded from plastics material. The housing 3 is in two halves 3*a*, 3*b* which are attached together by, for example, ultrasonic welding. The housing 3 is of generally elongate box shape and open at one end 4. A blade carrier 5 is carried at the open end 4 of the housing 3. Cylindrical posts 24 are formed inside one housing half 3*b* and are a push fit inside cylindrical posts 25 formed in the other housing half. Ribs 26, 27 are also provided to strengthen the housing.

An eye 6 is formed in an end of each side wall 7 of the housing 3 adjacent the open end 4. The eyes 6 each have a small recess 8 formed in their inner surface 9. The blade carrier 5 is generally cylindrical in shape. A channel shaped slot 10 in the carrier 5 receives a steel blade 11. The blade 11 is a held in the slot 10 adjacent a wall 12 of the slot by a rib 13 which extends up from an opposite wall 12' of the slot and ribs 28 on the wall 12 which engage recess 29 in the ends of the blade. A longitudinal cutting edge 14 is formed on the blade 11 by a chamferred edge.

The carrier 5 is stepped at each end 18, the stepped ends 18 being received in the eyes 6 of the housing 3. A nib 19 is formed on each end 18 of the carrier 5 and is received in a recess 8 in each eye 6.

The chamfered cutting edge 14 of the blade 11 has a surface 16 extending generally tangentially to a notional circle formed about the axis of the carrier 5, on a diameter larger than that of the carrier 5 so as to be proud of the outer circumferential surface of the carrier 5.

A cylindrical stainless steel mesh 20 forming a particular feature of this invention is loosely and rotatably mounted about the carrier 5 and blade 11. The mesh 20 is formed from flat stainless steel sheet of the required thickness. Apertures of the mesh can be formed in the flat sheet by conventional techniques, such as stamping or punching but photoetching is preferred. The flat sheet is then rolled into a cylinder so that the circumferential ends 21, 22 of the sheet overlap. The overlapping ends are secured together, for example by welding or gluing. The rolled sheet has an internal diameter about equal to or slightly greater than the notional circle related tangentially to the surface 16 of the cutting edge 14. The formed cylindrical mesh 20 is then mounted about the carrier 5 and blade 11 with the edge 23 of the inner end 22 of the mesh facing in the same direction as the blade cutting edge 14. Accordingly as the mesh 20 rotates in the direction of the arrow A, the joint in the mesh will pass smoothly over the blade.

The shaver is assembled by fitting the blade 11 in the carrier 5, and sliding the formed cylindrical mesh 20 over the blade and carrier. The housing halves 3*a*, 3*b* are assembled with the carrier mounted between the eyes 6 and then the housing halves 3*a* and 3*b* are welded together ultrasonically, the carrier ends 18 also being welded in the eyes 6.

In use, the shaver is held generally perpendicular to the face or other surface to be shaved and passed down the surface in the direction of arrow B. Hairs or the like will penetrate the holes of the mesh which will roll over the face, the hairs being cut between the mesh and the blade cutting edge 14. The shavings collect in the slot 10 and can be shaken out through the eyes 6.

By substantially reducing the cost of the mesh 20, a small portable, disposable shaver of low cost can be provided. The shaver can be very compact, the casing measuring about 36 mm×34 mm×17 mm, with a mesh diameter of about 10 mm. The mesh thickness is typically 0.15 mm with a hexagonal array of apertures of diameter about 0.5 mm on a center to center spacing of 0.6 mm.

Various modifications may be made to the described embodiment and it is desired to include all such modifications as fall within the scope of the accompanying claims.

What is claimed is:

1. A non-electric, manually-operable shaver, comprising a manually grippable holder, including a housing having two opposed sidewalls each having an eye at an end thereof, a carrier non-rotatably secured in the holder, the carrier being generally cylindrical in shape and defining a longitudinal groove therein, the carrier being mounted in the eyes of the housing and the groove communicates with the eyes to allow shavings to be taken out of the groove through the eyes, a single stationary blade fixedly supported by the carrier and having a longitudinally extending cutting edge adjacent to and facing the groove, a cylindrical mesh surrounding the blade and carrier and mounted to rotate around the blade and carrier so as to pass first over the groove and then over the blade in order to provide a cutting action between the mesh and the blade adjacent to the longitudinal groove, in which shaver the mesh is pre-formed from a flat sheet of screen material which is rolled to form a cylinder, with the ends of the rolled sheet overlapping by a small circumferential amount and securely fastened together to form a seam and the cylindrical screen being slid axially over the blade and carrier.

2. A shaver as claimed in claim 1, wherein a nib is formed on each end of the cylindrically-shaped blade carrier, and a recess is formed in each eye of the housing, such that the nibs are received in the recesses in order to secure the blade carrier in the housing in non-rotational relationship.

3. A shaver as claimed in claim 1, wherein the mesh rotates in a first direction, and a radially inner one of the overlapping mesh ends has an edge which faces in a direction opposite to the first direction, whereby the seam passes smoothly over the blade.

4. A shaver as claimed in claim 1, wherein the cutting edge of the blade is chamfered and faces in said direction opposite to the first direction.

5. A shaver as claimed in claim 1, wherein the overlapping ends of the rolled mesh are welded together.

6. A shaver as claimed in claim 1, wherein the overlapping ends of the rolled mesh are glued together.

7. A shaver as claimed in claim 1, wherein the longitudinal groove in the carrier has a flat wall and a rib is formed on a wall of the groove opposite said flat wall such that the blade is sandwiched between the rib and flat wall.

* * * * *

UNITED STATES PATENT AND TRADEMARK OFFICE

CERTIFICATE OF CORRECTION

PATENT NO. : 4,912,845

DATED : April 3, 1990

INVENTOR(S) : Shoichi Inoue

It is certified that error appears in the above-identified patent and that said Letters Patent is hereby corrected as shown below:

On the Title Page:

Column 1, after the filing date, insert:

"[30] Foreign Application Priority Data

Feb. 19, 1987 [JP] Japan.....62 3664"

Signed and Sealed this

Fifteenth Day of December, 1992

*Attest:*

DOUGLAS B. COMER

*Attesting Officer*

*Acting Commissioner of Patents and Trademarks*